US009522472B2

(12) United States Patent
Leicht et al.

(10) Patent No.: US 9,522,472 B2
(45) Date of Patent: Dec. 20, 2016

(54) RAZOR WITH A HANDLE AND ROTATABLE CUTTING UNIT

(71) Applicant: Feintechnik GmbH Eisfeld, Eisfeld (DE)

(72) Inventors: Danilo Leicht, Auengrund OT Crock (DE); Uwe Denkert, Neustadt (DE)

(73) Assignee: FEINTECHNIK GMBH EISFELD, Eisfeld (DE)

( * ) Notice: Subject to any disclaimer, the term of this patent is extended or adjusted under 35 U.S.C. 154(b) by 227 days.

(21) Appl. No.: 14/258,769

(22) Filed: Apr. 22, 2014

(65) Prior Publication Data

US 2015/0217466 A1 Aug. 6, 2015

(30) Foreign Application Priority Data

Jan. 31, 2014 (EP) ..... 14153361

(51) Int. Cl.
*B26B 21/22* (2006.01)
*B26B 21/40* (2006.01)
*B26B 21/52* (2006.01)

(52) U.S. Cl.
CPC ..... *B26B 21/225* (2013.01); *B26B 21/4075* (2013.01); *B26B 21/521* (2013.01)

(58) Field of Classification Search
CPC ... B26B 21/225; B26B 21/521; B26B 21/4075
See application file for complete search history.

(56) References Cited

U.S. PATENT DOCUMENTS 1,639,441 A * 8/1927 Spahr ..... B26B 21/28 16/224
5,560,106 A 10/1996 Armbruster
5,787,586 A * 8/1998 Apprille, Jr. ..... B26B 21/225 30/47
6,115,924 A * 9/2000 Oldroyd ..... B26B 21/225 30/526
6,161,288 A * 12/2000 Andrews ..... B26B 21/00 30/50

(Continued)

FOREIGN PATENT DOCUMENTS

BE 1000779 A7 4/1989
CA 2443881 A1 4/2005

(Continued)

*Primary Examiner* — Hwei C Payer
(74) *Attorney, Agent, or Firm* — Florek & Endres PLLC

(57) ABSTRACT

The invention relates to a razor (01) having a handle (03), a cutting unit (02) and a coupling portion (04, 12) for attaching in a detachable manner the cutting unit (02) on the handle (03). The cutting unit (02) comprises a razor blades unit (06) having one or multiple razor blades, wherein the razor blades unit (06) can be pivoted about a pivot axis that extends parallel to the longitudinal extension of the razor blades. The coupling portion comprises a mounting (12) and a rod (04) that is pivoted in the mounting. The pivot axis of the pivot bearing that is formed between mounting (12) and rod (04) basically extends perpendicularly to the pivot axis of the razor blades unit and basically parallel to the longitudinal axis of the rod (04), wherein the pivot bearing allows the cutting unit (02) to rotate in relation to the handle (03) at a rotation angle of at least 2° and at the most 20°.

17 Claims, 4 Drawing Sheets

(56) References Cited

U.S. PATENT DOCUMENTS

Figure 1:
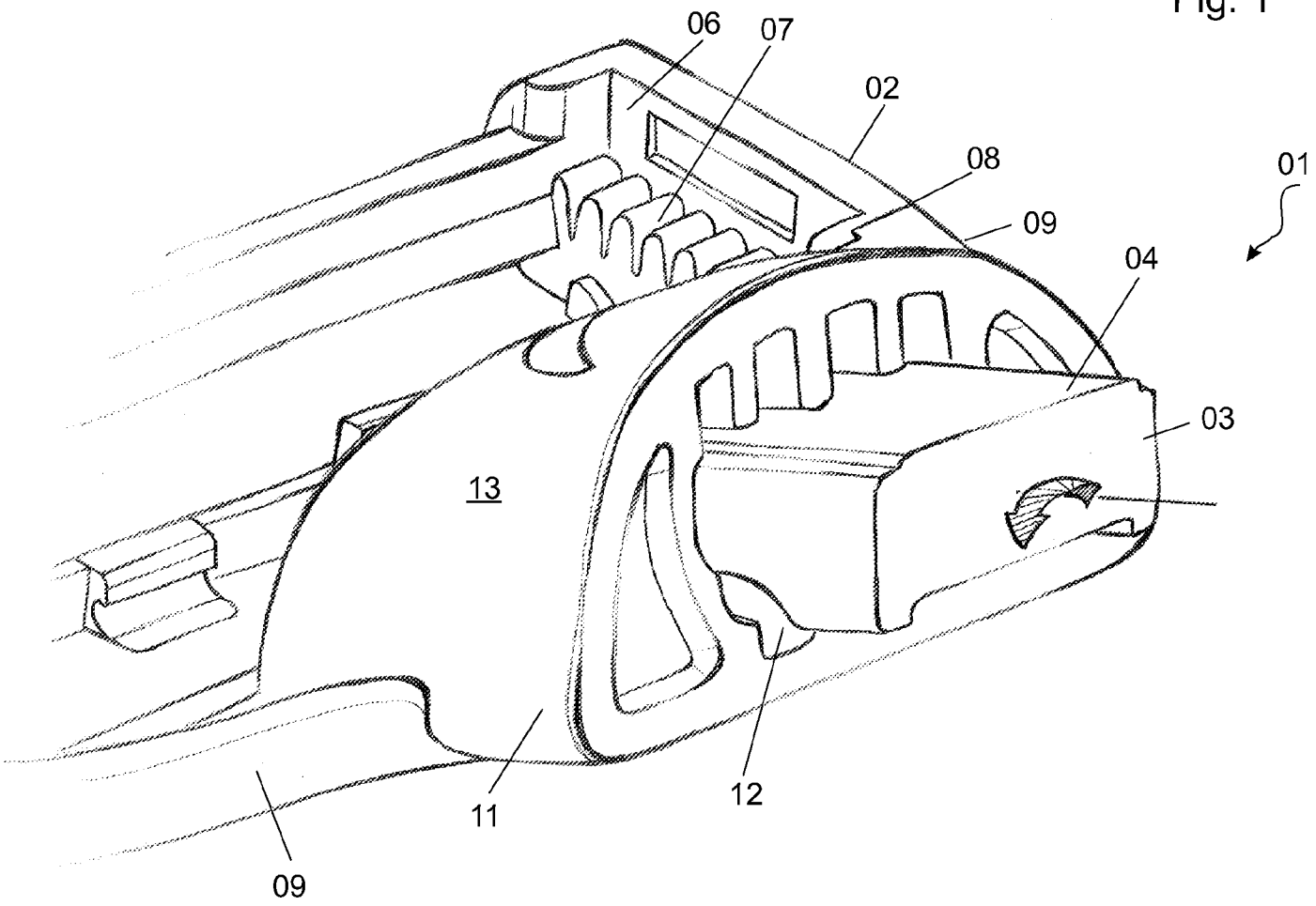

| | | | | |
|---|---|---|---|---|
| 6,615,498 | B1 * | 9/2003 | King | B26B 21/225 30/527 |
| 8,096,054 | B2 * | 1/2012 | Denkert | B26B 21/225 30/50 |
| 8,205,344 | B2 * | 6/2012 | Stevens | B26B 21/521 30/526 |
| 2009/0313837 | A1 * | 12/2009 | Winter | B26B 21/521 30/527 |
| 2011/0035950 | A1 * | 2/2011 | Royle | B26B 21/521 30/532 |
| 2011/0138637 | A1 * | 6/2011 | Bucco | B26B 21/521 30/527 |
| 2011/0173821 | A1 | 7/2011 | Hage et al. | |
| 2012/0255185 | A1 * | 10/2012 | Patel | B26B 21/4093 30/527 |
| 2012/0260509 | A1 | 10/2012 | Fang et al. | |
| 2013/0081290 | A1 | 4/2013 | Murgida et al. | |
| 2013/0291391 | A1 | 11/2013 | Stevens | |
| 2014/0033551 | A1 | 2/2014 | Szczepanowski et al. | |
| 2014/0109735 | A1 * | 4/2014 | Shepperson | B26B 21/521 83/13 |
| 2015/0217466 | A1 * | 8/2015 | Leicht | B26B 21/4075 30/50 |

FOREIGN PATENT DOCUMENTS

| | | | |
|---|---|---|---|
| DE | 202007002013 | U1 | 4/2007 |
| EP | 1 053 837 | A3 * | 5/2001 |
| EP | 2123410 | B1 | 7/2011 |
| EP | 2583800 | A1 | 4/2013 |
| EP | 2 902 156 | A1 * | 8/2015 |
| JP | 4-22388 | * | 1/1992 |
| WO | 2011019577 | A1 | 2/2011 |

* cited by examiner

RAZOR WITH A HANDLE AND ROTATABLE CUTTING UNIT

The present invention relates to a razor, namely a so-called wet razor, which has a handle, a cutting unit and a coupling portion for attaching the cutting unit at the handle. At the same time, the cutting unit is attached in such a way that it can be rotated in relation to the handle. The cutting unit comprises a razor blades unit having one or preferably multiple razor blades, in particular three, four or five razor blades. The razor blades unit is pivoted about a pivot axis extending parallel to the longitudinal extension. The coupling portion of the razor comprises a mounting and a rod that is axially fixed and at the same time able to rotate in said mounting.

EP 1 053 837 B1 shows a razor having a replaceable shaving cartridge. The shaving cartridge comprises a housing with one or several razor blades, a glide strip, a cap and a connecting member with a pivotable carrier structure. The housing can be pivoted about a pivot axis. The carrier structure and an adjacent basic structure allow the shaving cartridge to be fixed on, but also detachable from an extension of the handle. Basically, there exists a plug connection between the connecting structure and the extension of the handle. For this purpose, the basic structure has a recess with internal surfaces which engage with the external surfaces of the extension of the handle. The plug connection has the purpose of fixing the shaving cartridge as rigidly as possible in the handle but, at the same time, making it easy for the user to replace the shaving cartridge.

WO 89/10245 A1 describes a razor which has a handle and a resilient razor blades holder. A pivot joint allows the razor blades holder to make a pivoting motion in relation to the handle wherein the pivot axis extends basically parallel to the cutting edges of the razor blades in the razor blades holder. Furthermore, provision has been for a resilient bearing, which under respective application of force allows the razor blades holder to make pitch, torsional and translational motions in relation to the handle, wherein the razor blades holder returns to its normal position when the force is eliminated. However, this resilient bearing always results in a superposition of several motions, wherein it is impossible to smoothly move the entire cutting unit in relation to the handle. The resilient bearing is permanently integrated in the handle and requires respective installation efforts when manufacturing the razor.

JP 04 022 388 A shows a razor in which a razor blades unit is rotatably mounted in a fork mount. This allows the razor blades unit to pivot about a pivot axis parallel to the longitudinal extension of the razor blades. The fork mount is connected with a connecting portion which, in turn, is connected with the handle of the razor. There is a pivot bearing, wherein the pivot axis basically extends perpendicular to the longitudinal extension of the razor blades, as well as perpendicular to the longitudinal extension of the handle section, which protrudes into the connecting portion. The razor blades unit can be replaced by separating the unit from the fork mount so that the pivot bearing designed in the connecting portion does not have to be opened.

WO 2009/154921 A2 shows a razor with a razor blades unit which is connected with the handle by means of a connecting member. The razor blades unit is able to pivot about a first axis which extends parallel to the cutting edges. In addition, the razor blades unit is able to pivot about a second axis which extends perpendicular to the cutting edges. The connecting member has an idle position, wherein a reset force is activated when the razor blades unit is pivoted from the idle position about the second axis. Furthermore, a relative motion transmission component is required, in order to transmit a relative motion between handle and razor blades unit caused by the pivoting motion about the second axis. This results in a complicated structure with multiple components, producing considerable installation efforts when manufacturing the razor. When the razor blades are worn out, the razor blades unit is detached from the connecting member so that the remaining bearing elements are not affected.

Finally, EP 2 123 410 B1 shows a razor blades unit for a razor which has a razor blades housing with several razor blades and a coupling portion, which can be detachably mounted to a handle. An integral hinge is designed between the razor blades housing and the coupling portion, which defines a pivot axis extending parallel to the main level of contact. The coupling portion comprises a sleeve into which an adapter portion can be inserted, in order to fix the entire razor blades unit at the handle. This results in a detachable connection, which is inflexible during periods of use.

Based on the razor blades unit described in EP 2 123 410 B1, the present invention has the object of providing an improved razor which has a razor blades unit that adapts more effectively to the contours of the skin surface to be shaved. In particular, a further movement about an additional pivot axis should be provided without making the entire structure of the razor considerably more complicated, but at the same time maintaining a plug connection by means of which a user can replace in an easy manner the razor blades unit.

These, as well as further problems are solved by a razor and a cutting unit according to the present invention.

The invention-based razor is characterized by a specific design of the coupling portion between cutting unit and handle. Basically, on the one hand, said coupling portion comprises a mounting and, on the other hand, a rod that is inserted in the mounting. Preferably, the mounting is designed in the form of a sleeve with a non-circular opening cross-section into which a longitudinal rod is inserted in order to form a coupling. The external shape of the rod and the internal contour of the mounting are adjusted to each other in such a way that the rod can be easily inserted by the user. However, when reaching its end position in axial direction, it is fixed to the extent that the resulting coupling cannot be automatically detached. For example, this is accomplished in that leaf springs or snap-in pins engage in respective recesses of the respectively opposite coupling portion. However, different from the generally known design, the mounting and rod in the coupling portion of the invention-based razor are adjusted to each other in such a way that, on the one hand, a fixed connection is produced in axial direction, which can be detached to replace the cutting unit but, on the other hand, it is still possible to make a rotary motion about a pivot axis. At the same time, the pivot axis extends basically parallel to the longitudinal axis of the rod and basically perpendicular to the pivot axis of the razor blades unit. In particular, the pivot bearing designed between the mounting and the rod allows the cutting unit to pivot at a predetermined rotation angle of preferably 2° and at the most 20° in relation to the handle.

According to an especially preferred embodiment, the longitudinal axis of the rod basically extends parallel to the longitudinal axis of the handle of the razor, namely at an angular deviation of <10°.

Designing a pivot bearing in the coupling portion has the significant advantage that the cutting unit can basically be rotated at a predetermined angular range about the longitudinal axis of the handle. At the same time, the razor blades unit can be pivoted in unrestricted manner about the pivot axis which is extending parallel to the razor blades. In this way, the razor blades unit adapts considerably better to the contours of the skin surface during the process of shaving than if it was only possible to pivot about the pivot axis of the razor blades unit. Because of the fact that the pivot bearing is integrated in the coupling portion the razor has a simple structure without multiple components, resulting in simple assembly steps when manufacturing the razor or cutting unit. In addition, this design has the advantage that the handles of well-known razors can be equipped with invention-based cutting units, thus providing the razor with the invention-based function of rotating about the longitudinal axis of the handle without the need of replacing the existing handle.

In a preferred embodiment, the mounting comprises one or several spring elements protruding into the internal space, which push the inserted rod into an idle position. Then the rod can be rotated at a predetermined angle ranging between 1° and 10° from this idle position in both directions in relation to the mounting. Preferably, the spring elements are designed in the form of spring arms, which are arranged on the opposite wall sections of the mounting. In this case, the free ends of the spring arms impact the rod inserted in the mounting.

In a preferred embodiment, the mounting of the coupling portion is an integral part of the cutting unit. In this case, the rod is designed to be an extension of the handle, preferably in rectangular shape, wherein the cross-section of the rod can have a polygonal shape, in order to adapt to the hollow space of the mounting. To this end, it is important that the rod can be rotated at the predetermined angle within the mounting and, at the same time, supported through an attachment to bearing points and/or bearing lines. In this case, the cross-sectional area of the rod is evidently smaller than that of the opening cross-section of the mounting, especially smaller by between 5% and 50%, so as to allow for the rod to rotate in the mounting. However, in modified embodiments, the mounting can also be designed at the handle when the cutting unit is provided with a complementary rod, again in order to design the coupling portion together with the mounting.

It is especially preferred when the razor blades unit is permanently connected with the mounting of the coupling portion, so that the part of the razor blades unit comprising the mounting is also exchanged when a used razor blades unit is replaced. Especially with this design, it is practical when the pivot axis about which the razor blades unit can be rotated is formed by two integral hinges, which are arranged at the lateral edges of the razor blades unit.

Figure 2:
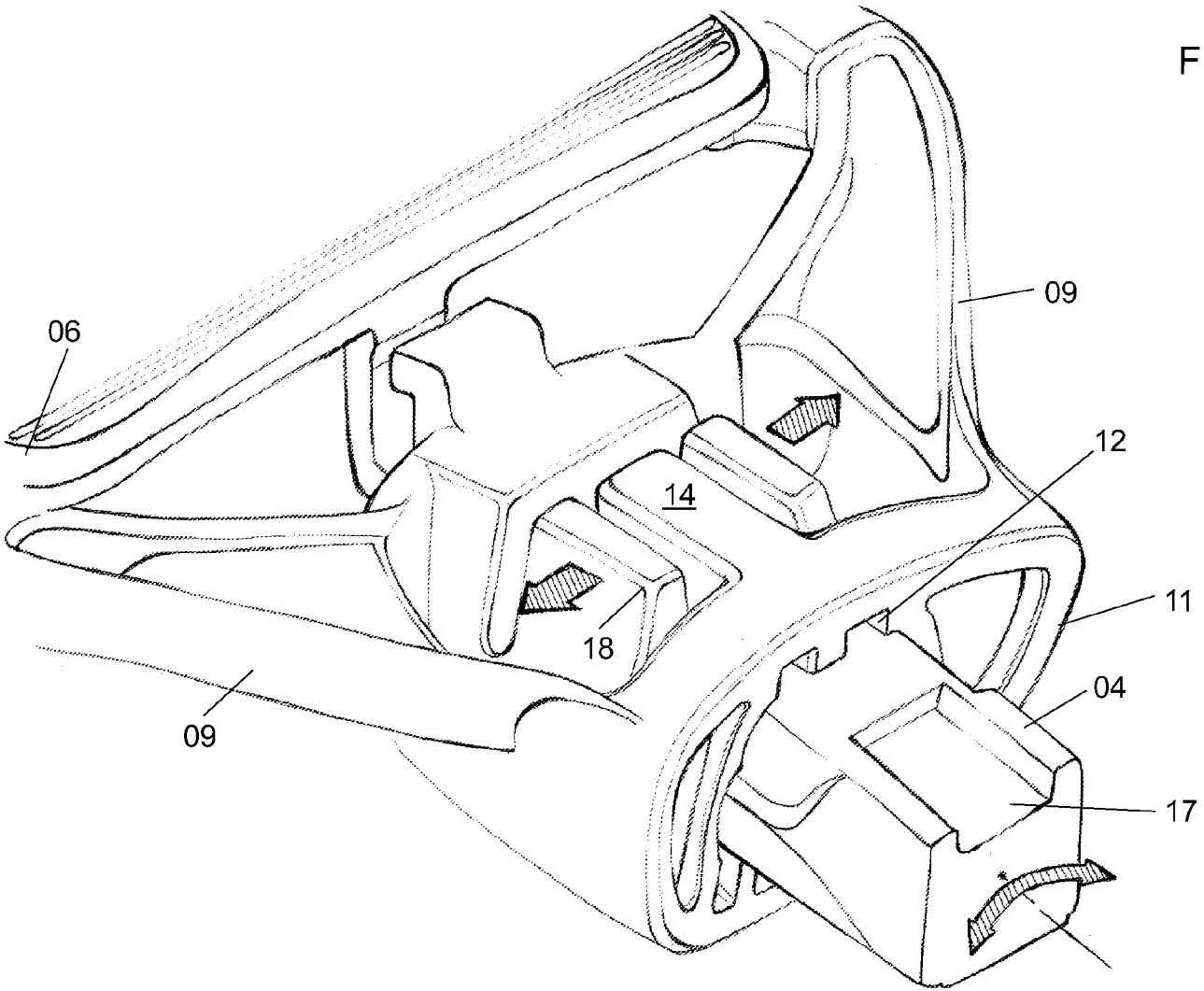
Figure 3:
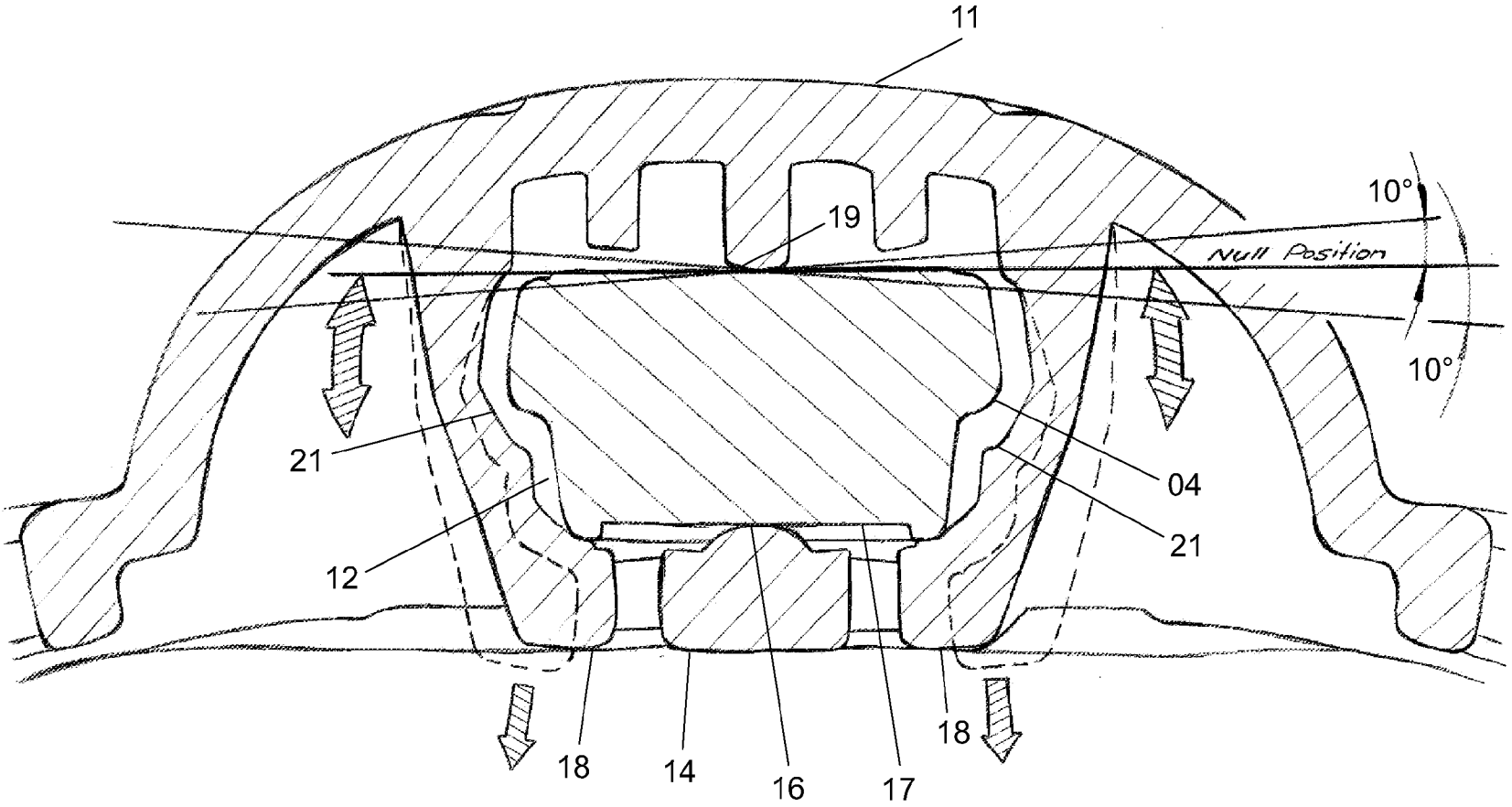
Figure 4:
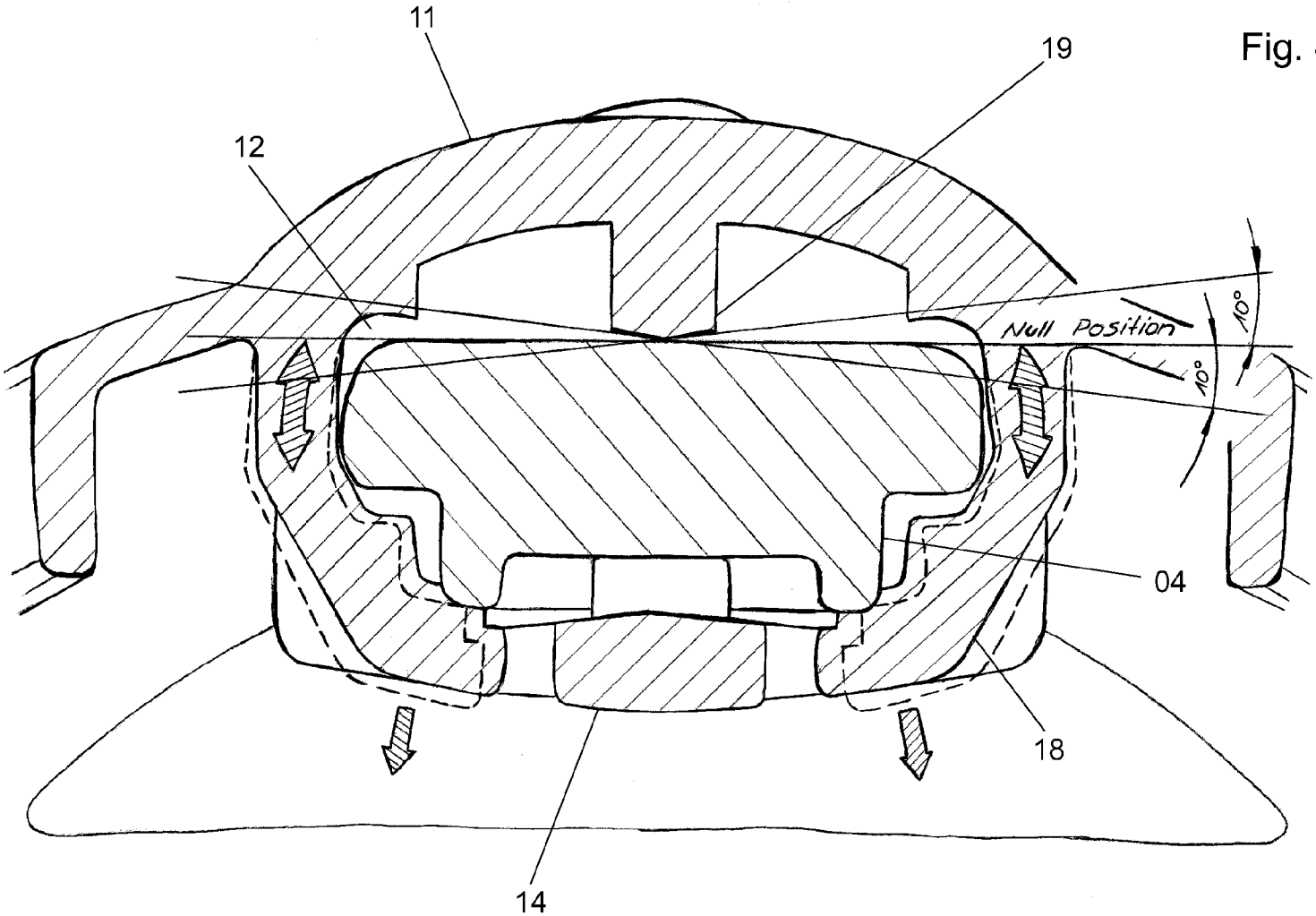

With reference to the drawing, the subsequent description of preferred embodiments provides further advantages, details and further developments of the present invention. It is shown:

FIG. 1: a detailed view of a first embodiment of an invention-based razor in a simplified perspective view from the top;

FIG. 2: a detailed view of the razor in a simplified perspective view from the bottom;

FIG. 3: a cross-sectional view of a coupling portion of the razor;

FIG. 4: a simplified cross-sectional view of a second embodiment of the razor with a modified coupling portion.

In a perspective view from the top, FIG. 1 shows a section of a razor 01, the main component of which are formed by a cutting unit 02 and a handle 03. The illustration shows only a frontal extension of the handle in the form of a rod 04. The handle held by the user when using the razor is not shown.

The cutting unit 02 has a razor blades unit 06 with a razor blades holder 07, in which in the example shown five individual razor blades (not shown) can be inserted. Basically, said individual razor blades are fixed in the razor blades unit 06. Furthermore, the razor blades unit has a generally known foam edge arranged in shaving direction in front of the cutting edges of the razor blades for pre-tensioning the skin during the process of shaving, as well as a glide strip situated in shaving direction behind the cutting edges of the razor blades. It is also possible to provide different designs of the razor blades unit.

In the embodiment shown, the cutting unit 02 is connected with respective lateral support arms 09 via integral hinges 08 arranged on both sides. The integral hinges 08 define the position of a pivot axis, which basically extends parallel to the longitudinal direction of the razor blades and about which the razor blades unit 02 can be rotated during the process of shaving. The pivot axis can also be formed by a variable pivot portion, which is particularly the case with integral hinges.

The support arms 09 unite in a centrally located dome attachment 11, which has a mounting 12 on the inside. The mounting 12 comprises a hollow space, into which the rod 04 is inserted, in order to attach the cutting unit 02 on the handle 03. On its outside, the dome attachment 11 is preferably shaped in such a way that it provides one or multiple operating areas 13, which the user can hold for replacing the cutting unit, in order to remove the cutting unit in axial direction from the rod 04. Together with the inserted rod 04, the mounting 12 forms a coupling portion.

When the rod 04 has been inserted in the mounting 12, a fixed connection is formed in axial direction between the cutting unit 02 and the handle 03, so that the cutting unit cannot be automatically detached from the handle. However, the depicted motion arrow shows that even when inserted in the mounting 12 the rod 04 can make a rotary motion in both directions, starting at a zero position. For this purpose, even with a rod having a polygonal cross-section the mounting 12 has sufficient clearance for allowing the rotary motion at a predetermined angular range.

FIG. 2 especially shows the coupling portion as a detail of the razor in a simplified perspective view from the bottom. In this representation, the rod 04 has not been completely inserted in the mounting 12. The mounting 12 has a locking lug 14 with a locking pin 16 (see FIG. 3), which engages in a detent recess 17 provided in the rod when the rod 04 has been completely inserted, in order to axially fix the rod 04. Furthermore, in the example shown, the mounting 12 comprises two spring arms 18, which can be radially pivoted and which can impact the lateral surfaces of the rod 04, in order to push it into a zero position.

FIG. 3 shows a cross-sectional view through the coupling portion. It is apparent that the rod 04 when inserted does not completely fill the hollow space of the mounting 12 and, apart from respective bearing points, is not in contact with the internal surfaces of the mounting, in order to allow for the rotary motion of the rod. One bearing point is formed by the locking pin 16, which is engaged in the detent recess 17. Opposite of the locking pin 16 there is a guide rib 19, which also attaches in a linear manner on the opposite side of the rod 04, resulting in the fact that the rod is fixed between the locking pin 16 and the guide rib 19.

FIG. 3 shows the rod 04 in a zero position, i.e., without torsion about its longitudinal axis. However, the depicted angular lines and motion arrows show that even in this position the rod 04 can be rotated about its longitudinal axis. However, further degrees of freedom are blocked. The lower lateral edges of the rod 04 attach to the free ends of the spring arms 18 and which are pretensioned when the rod 04 is inserted into the mounting 12 and, as a result, also contribute to the fixation of the rod 04. In the embodiment shown, the bearing line between the upper side of the rod 04 and the guide rib 19 forms the pivot bearing for the rod, while the surface of the detent recess 17 glides over the locking pin 16 when the rod 04 is triggered to rotate.

If as a result of an outside force a torsional moment is exerted on the cutting unit in relation to the handle, the cutting unit is rotated in relation to the rod 04, wherein the pivot axis is located or extends parallel to the longitudinal axis. When the rod 04 rotates in relation to the cutting unit, the spring arms 18 are also shifted, because the position of the lower lateral edges of the rod 04 has changed. The respectively dotted position illustrates the shifting of the spring arms 18. The rotation of the rod 04 is restricted by means of stop surfaces 21 within the mounting 12. For example, the spring stiffness of the spring arms is dimensioned in such a way that at the end of the spring arm 18 a force in the range of between 5 and 30 N occurs when the cutting unit is rotated up to the stop.

The locking lug 14, as well as the spring arms 18 are integrally molded with the mounting 12 and the dome attachment 11, preferably in the form of a plastic injection-molded part. It is also advantageous when the support arms 09 are integrally formed in the same production step and also the remaining housing components of the razor blades unit are produced in this single injection-molding process.

A preferred embodiment is characterized in that the housing parts of the razor blades unit, the support arms, the entire mounting and at least the supporting portions of the integral hinges are produced from one and the same plastic material. When using a two-component plastic injection device, it is also possible to integrally form in a respective procedural step further soft elastic components of the integral hinges and the foam edge. As a result, the production of the entire cutting unit can be considerably simplified.

FIG. 4 shows a simplified cross-sectional view of a modified embodiment of the razor. Significant differences especially result from the modified shape of the rod 04 and the mounting 12. However, the functional principle remains the same. The rod 04 is only fixed in the mounting 12 in axial direction, while it still can be rotated about a pivot axis within the predetermined angular range. At the internal edge of the guide rib 19, a linear contact occurs, so that there the pivot axis is located. The spring arms 18 apply a spring force on the rod 04, so that the absence of an external moment results in the fact that the rod is pushed into a zero position, while the spring arms 18 rotate laterally to the outside when a moment overcoming the spring force is impressed.

Furthermore, the present invention relates to the replaceable cutting unit described above. Normally, such cutting units are offered in the form of replacement elements for the respective razors, wherein the handle of the razor can be used repeatedly.

LIST OF REFERENCE NUMERALS

01—Razor
02—Cutting unit
03—Handle
04—Rod
05—
06—Razor blades unit
07—Razor blades holder
08—Integral hinge
09—Support arms
10—
11—Dome attachment
12—Mounting
13—Operating area
14—Locking lug
15—
16—Locking pin
17—Detent recess
18—Spring arms
19—Guide rib
20—
21—Stop surfaces

The invention claimed is:

1. A razor having a handle, a cutting unit and a coupling portion for attaching in a detachable manner the cutting unit on the handle, wherein the cutting unit comprises a razor blades unit with one or multiple razor blades, wherein the razor blades unit can be rotated about a pivot axis that is extending parallel to the longitudinal extension of the razor blades, wherein the coupling portion comprises a mounting and a rod that are fixedly connected in an axial direction, but said rod is able to make a rotary motion while fixedly connected as said rod is pivoted in the mounting, wherein a pivot axis of a pivot bearing formed between said mounting and said rod basically extends perpendicularly to the pivot axis of the razor blades unit and basically parallel to the longitudinal axis of the rod, and wherein the pivot bearing allows the cutting unit to rotate in relation to the handle at a rotation angle of at least 2° and at the most 20°, the mounting further comprising two spring arms mounted on opposite walls of the mounting which push the rod into an idle position, wherein the rod can be rotated from the idle position in both directions in relation to the mounting at a rotation angle of at least 1° and at most 10°, each of said two spring arms having a free end coming into contact with the rod inserted in the mounting.

2. The razor according to claim 1, characterized in that the mounting of the coupling portion is an integral component of the cutting unit, while the rod is designed in the form of an extension of the handle, which can be inserted into the mounting to attach the cutting unit to the handle.

3. The razor according to claim 1, characterized in that the razor blades unit is permanently connected with the mounting of the coupling portion.

4. The razor according to claim 3, characterized in that the pivot axis of the razor blades unit is formed by two integral hinges, which are attached at the lateral edges of the razor blades unit and which connect the razor blades unit with the mounting via two support arms.

5. The razor according to claim 1, characterized in that in the mounting the rod comes in contact along bearing lines and/or bearing points only at the free ends of said spring arms, a locking pin and a guide rib located opposite the locking pin.

6. The razor according to claim 1 wherein the rod can be rotated to 5° from said idle position in both directions in relation to said mounting.

7. The razor according to claim 1 wherein the rod can be rotated to 2° from said idle position in both directions in relation to said mounting.

8. A razor having a handle, a cutting unit and a coupling portion for attaching in a detachable manner the cutting unit on the handle, wherein the cutting unit comprises a razor blades unit with one or multiple razor blades, wherein the razor blades unit can be rotated about a pivot axis that is extending parallel to the longitudinal extension of the razor blades, wherein the coupling portion comprises a mounting and a rod that are fixedly connected in an axial direction, but said rod is able to make a rotary motion while fixedly connected as said rod is pivoted in the mounting, wherein a pivot axis of a pivot bearing formed between said mounting and said rod basically extends perpendicularly to the pivot axis of the razor blades unit and basically parallel to the longitudinal axis of the rod, and wherein the pivot bearing allows the cutting unit to rotate in relation to the handle at a rotation angle of at least 2° and at the most 20°, and further wherein the mounting has a non-circular opening cross-section and the rod has a polygonal cross-section, the surface of which is smaller by between 10% and 50% than the opening cross-section of the mounting.

9. The razor according to claim 8, characterized in that the mounting of the coupling portion is an integral component of the cutting unit, while the rod is designed in the form of an extension of the handle, which can be inserted into the mounting to attach the cutting unit to the handle.

10. The razor according to claim 8, wherein the mounting further comprises two spring arms mounted on opposite walls of the mounting which push the rod into an idle position, wherein the rod can be rotated from the idle position in both directions in relation to the mounting at a rotation angle of at least 1° and at most 10°, each of said two spring arms having a free end coining into contact with the rod inserted in the mounting.

11. The razor according to claim 10, characterized in that in the mounting the rod comes in contact along bearing lines and/or bearing points only at the free ends of said spring arms, a locking pin and a guide rib located opposite the locking pin.

12. A razor having handle, a cutting unit and a coupling portion for attaching in a detachable manner the cutting unit on the handle, wherein the cutting unit comprises a razor blades unit with one or multiple razor blades, wherein the razor blades unit can be rotated about a pivot axis that is extending parallel to the longitudinal extension of the razor blades, wherein the coupling portion comprises a mounting and a rod that are fixedly connected in an axial direction, but said rod is able to make a rotary motion while fixedly connected as said rod is pivoted in the mounting, wherein a pivot axis of a pivot bearing formed between said mounting and said rod basically extends perpendicularly to the pivot axis of the razor blades unit and basically parallel to the longitudinal axis of the rod, and wherein the pivot bearing allows the cutting unit to rotate in relation to the handle at a rotation angle of at least 2° and at the most 20°, and further wherein the mounting comprises a resilient locking lug with a locking pin, which engages in a detent recess formed in the rod when the rod is inserted into the detent recess, wherein a latching connection thus established fixes the rod in the mounting in the direction of its longitudinal extension and continues to allow the mounting to rotate about the rod.

13. The razor according to claim 12, characterized in that the mounting of the coupling portion is an integral component of the cutting unit, while the rod is designed in the form of an extension of the handle, which can be inserted into the mounting to attach the cutting unit to the handle.

14. The razor according to claim 12, wherein the mounting further comprises two spring arms mounted on opposite walls of the mounting which push the rod into an idle position, wherein the rod can be rotated from the idle position in both directions in relation to the mounting at a rotation angle of at least 1° and at most 10°, each of said two spring arms having a free end coming into contact with the rod inserted in the mounting.

15. The razor according to claim 14, characterized in that in the mounting the rod comes in contact along bearing lines and/or bearing points only at the free ends of said spring arms, a locking pin and a guide rib located opposite the locking pin.

16. A replaceable cutting unit for a razor, the cutting unit having a razor blades unit comprising one or multiple razor blades, wherein said razor blades unit can be pivoted about a pivot axis extending parallel to the longitudinal extension of the razor blades, with said cutting unit having a mounting for attaching the cutting unit on a handle, wherein the mounting provides bearing lines and/or bearing points for a rod of the handle, which rod has a polygonal cross-section and can be rotatably inserted in the mounting, wherein the bearing lines and/or bearing points are formed by:

- free ends of two spring arms arranged on opposite wall sections of the mounting;
- a locking pin protruding from a locking lug into a hollow space of the mounting; and
- a guide rib located opposite the locking pin.

17. The replaceable cutting unit according to claim 16, characterized in that the mounting of the coupling portion is an integral component of the cutting unit, while the rod is designed in the form of an extension of the handle, which can be inserted into the mounting to attach the cutting unit to the handle.

* * * * *